US008215277B2

(12) United States Patent
Suzuki et al.

(10) Patent No.: US 8,215,277 B2
(45) Date of Patent: Jul. 10, 2012

(54) SPARK PLUG

(75) Inventors: Akira Suzuki, Nagoya (JP); Tomoaki Kato, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 107 days.

(21) Appl. No.: 12/933,745

(22) PCT Filed: Mar. 18, 2009

(86) PCT No.: PCT/JP2009/055232

§ 371 (c)(1),
(2), (4) Date: Sep. 21, 2010

(87) PCT Pub. No.: WO2009/116553

PCT Pub. Date: Sep. 24, 2009

(65) Prior Publication Data

US 2011/0017163 A1 Jan. 27, 2011

(30) Foreign Application Priority Data

Mar. 21, 2008 (JP) ..... 2008-072731

(51) Int. Cl.
*H01T 13/20* (2006.01)

(52) U.S. Cl. ..... 123/169 E

(58) Field of Classification Search ..... 123/169 R, 123/169 EL, 169 E, 169 G, 169 P
See application file for complete search history.

(56) References Cited

U.S. PATENT DOCUMENTS

| | | | | |
|---|---|---|---|---|
| 5,124,612 | A | 6/1992 | Takamura et al. | |
| 6,611,084 | B2 * | 8/2003 | Teramura et al. | 313/141 |
| 6,819,032 | B2 | 11/2004 | Matsubara | |
| 7,408,294 | B2 * | 8/2008 | Okabe et al. | 313/143 |
| 7,944,134 | B2 * | 5/2011 | Kyuno et al. | 313/141 |
| 8,115,371 | B2 * | 2/2012 | Kyuno et al. | 313/141 |
| 2003/0085643 | A1 | 5/2003 | Matsubara | |
| 2005/0057131 | A1 | 3/2005 | Kanao et al. | |
| 2005/0168120 | A1 | 8/2005 | Kanao et al. | |
| 2006/0028108 | A1 | 2/2006 | Okabe et al. | |
| 2010/0117507 | A1 * | 5/2010 | Suzuki et al. | 313/143 |
| 2011/0000453 | A1 * | 1/2011 | Kuribayashi et al. | 123/169 R |

FOREIGN PATENT DOCUMENTS

| | | | |
|---|---|---|---|
| JP | 61-61390 | A | 3/1986 |
| JP | 63-202874 | A | 8/1988 |
| JP | 2727558 | B2 | 12/1997 |
| JP | 2001237046 | A | 8/2001 |
| JP | 2005-116513 | A | 4/2005 |
| JP | 2005-243610 | A | 9/2005 |
| JP | 2006-49207 | A | 2/2006 |

* cited by examiner

*Primary Examiner* — Hai Huynh
(74) *Attorney, Agent, or Firm* — Sughrue Mion, PLLC

(57) ABSTRACT

A spark plug is provided capable of speedily burn off carbon adhered on an insulator. With this spark plug, in order to improve the temperature rise performance of a front end side of an insulator 10, an amount of protrusion H (mm) of the insulator 10, a front-end side volume Vi ($mm^3$) of the insulator 10, and a front-end side volume Vc ($mm^3$) of a center electrode 20 are respectively defined. In consequence, it is possible to improve the recovery property of carbon fouling while retaining the voltage resistance of the insulator 10 and the durability of the center electrode 20. In addition, since the recovery property of carbon fouling improves, it is possible to prevent the occurrence of side sparks generated from the center electrode 20 to a metal shell 50 along the insulator 10, thereby making it possible to stably ensure proper ignition of an air-fuel mixture.

4 Claims, 10 Drawing Sheets

FIG. 4

| SAMPLE NO. | H (mm) | Vi ($mm^3$) | Vc ($mm^3$) | Vc/Vi | EVALUATION |
|---|---|---|---|---|---|
| 1-1 | 0.8 | 13.63 | 2.10 | 0.15 | × |
| 1-2 | 0.8 | 13.17 | 6.42 | 0.49 | × |
| 1-3 | 0.8 | 12.51 | 3.54 | 0.28 | × |
| 1-4 | 0.8 | 12.50 | 6.42 | 0.51 | × |
| 1-5 | 0.8 | 9.04 | 4.41 | 0.49 | × |
| 1-6 | 0.8 | 9.02 | 6.42 | 0.71 | × |
| 1-7 | 0.8 | 8.77 | 3.54 | 0.40 | × |
| 1-8 | 0.8 | 8.42 | 6.98 | 0.83 | × |
| 1-9 | 0.8 | 7.74 | 6.42 | 0.83 | × |
| 1-10 | 0.8 | 7.09 | 4.41 | 0.62 | × |
| 1-11 | 0.8 | 7.08 | 5.88 | 0.83 | × |
| 1-12 | 0.8 | 6.45 | 5.36 | 0.83 | × |
| 1-13 | 0.8 | 5.90 | 5.88 | 1.00 | × |
| 1-14 | 0.8 | 5.28 | 4.41 | 0.83 | × |
| 1-15 | 0.8 | 4.96 | 6.42 | 1.29 | × |
| 1-16 | 0.8 | 4.26 | 4.41 | 1.03 | × |
| 1-17 | 0.8 | 4.22 | 3.54 | 0.84 | × |
| 1-18 | 0.8 | 4.02 | 2.10 | 0.52 | × |
| 1-19 | 0.8 | 3.91 | 5.36 | 1.37 | × |

*FIG. 5*

| SAMPLE NO. | H (mm) | Vi ($mm^3$) | Vc ($mm^3$) | Vc/Vi | EVALUATION |
|---|---|---|---|---|---|
| 2-1 | 1.8 | 16.51 | 8.17 | 0.49 | × |
| 2-2 | 1.8 | 13.63 | 2.10 | 0.15 | × |
| 2-3 | 1.8 | 13.17 | 6.42 | 0.49 | × |
| 2-4 | 1.8 | 8.42 | 6.98 | 0.83 | × |
| 2-5 | 1.8 | 5.13 | 6.98 | 1.36 | × |
| 2-6 | 1.8 | 4.96 | 6.42 | 1.29 | × |
| 2-7 | 1.8 | 3.91 | 5.36 | 1.37 | × |
| 2-8 | 1.8 | 1.74 | 2.77 | 1.60 | × |
| 2-9 | 1.8 | 12.51 | 3.54 | 0.28 | △ |
| 2-10 | 1.8 | 12.50 | 6.42 | 0.51 | △ |
| 2-11 | 1.8 | 9.04 | 4.41 | 0.49 | △ |
| 2-12 | 1.8 | 9.02 | 6.42 | 0.71 | △ |
| 2-13 | 1.8 | 7.74 | 6.42 | 0.83 | △ |
| 2-14 | 1.8 | 7.08 | 5.88 | 0.83 | △ |
| 2-15 | 1.8 | 5.90 | 5.88 | 1.00 | △ |
| 2-16 | 1.8 | 4.26 | 4.41 | 1.03 | △ |
| 2-17 | 1.8 | 8.77 | 3.54 | 0.40 | ○ |
| 2-18 | 1.8 | 7.09 | 4.41 | 0.62 | ○ |
| 2-19 | 1.8 | 6.45 | 5.36 | 0.83 | ○ |
| 2-20 | 1.8 | 5.28 | 4.41 | 0.83 | ○ |
| 2-21 | 1.8 | 4.22 | 3.54 | 0.84 | ○ |
| 2-22 | 1.8 | 4.02 | 2.10 | 0.52 | ○ |

*FIG. 6*

| SAMPLE NO. | H (mm) | Vi ($mm^3$) | Vc ($mm^3$) | Vc/Vi | EVALUATION |
|---|---|---|---|---|---|
| 3-1 | 2.8 | 13.63 | 2.10 | 0.15 | × |
| 3-2 | 2.8 | 8.42 | 6.98 | 0.83 | × |
| 3-3 | 2.8 | 4.96 | 6.42 | 1.29 | × |
| 3-4 | 2.8 | 12.51 | 3.54 | 0.28 | △ |
| 3-5 | 2.8 | 9.04 | 4.41 | 0.49 | △ |
| 3-6 | 2.8 | 9.02 | 6.42 | 0.71 | △ |
| 3-7 | 2.8 | 7.74 | 6.42 | 0.83 | △ |
| 3-8 | 2.8 | 7.08 | 5.88 | 0.83 | △ |
| 3-9 | 2.8 | 4.26 | 4.41 | 1.03 | △ |
| 3-10 | 2.8 | 8.77 | 3.54 | 0.40 | ○ |
| 3-11 | 2.8 | 6.45 | 5.36 | 0.83 | ○ |
| 3-12 | 2.8 | 4.22 | 3.54 | 0.84 | ○ |
| 3-13 | 2.8 | 4.02 | 2.10 | 0.52 | ○ |

*FIG. 7*

| SAMPLE NO. | H (mm) | Vi ($mm^3$) | Vc ($mm^3$) | Vc/Vi | EVALUATION |
|---|---|---|---|---|---|
| 4-1 | 3.8 | 13.63 | 2.10 | 0.15 | × |
| 4-2 | 3.8 | 8.42 | 6.98 | 0.83 | × |
| 4-3 | 3.8 | 4.96 | 6.42 | 1.29 | × |
| 4-4 | 3.8 | 12.51 | 3.54 | 0.28 | △ |
| 4-5 | 3.8 | 9.04 | 4.41 | 0.49 | △ |
| 4-6 | 3.8 | 9.02 | 6.42 | 0.71 | △ |
| 4-7 | 3.8 | 7.74 | 6.42 | 0.83 | △ |
| 4-8 | 3.8 | 7.08 | 5.88 | 0.83 | △ |
| 4-9 | 3.8 | 4.26 | 4.41 | 1.03 | △ |
| 4-10 | 3.8 | 8.77 | 3.54 | 0.40 | ○ |
| 4-11 | 3.8 | 6.45 | 5.36 | 0.83 | ○ |
| 4-12 | 3.8 | 4.22 | 3.54 | 0.84 | ○ |
| 4-13 | 3.8 | 4.02 | 2.10 | 0.52 | ○ |

*FIG. 8*

| SAMPLE NO. | H (mm) | Vi ($mm^3$) | FOULING RECOVERY PROPERTY | WITHSTAND VOLTAGE PROPERTY |
|---|---|---|---|---|
| 1 | 1.8 | 2.47 | ○ | × |
| 2 | 2.8 | 2.47 | ○ | × |
| 3 | 3.8 | 2.47 | ○ | × |
| 4 | 1.8 | 3.29 | ○ | × |
| 5 | 2.8 | 3.29 | ○ | × |
| 6 | 3.8 | 3.29 | ○ | × |
| 7 | 1.8 | 4.02 | ○ | × |
| 8 | 2.8 | 4.02 | ○ | × |
| 9 | 3.8 | 4.02 | ○ | × |
| 10 | 1.8 | 4.22 | ○ | ○ |
| 11 | 2.8 | 4.22 | ○ | ○ |
| 12 | 3.8 | 4.22 | ○ | ○ |
| 13 | 1.8 | 5.28 | ○ | ○ |
| 14 | 1.8 | 6.45 | ○ | ○ |
| 15 | 2.8 | 6.45 | ○ | ○ |
| 16 | 3.8 | 6.45 | ○ | ○ |
| 17 | 1.8 | 7.09 | ○ | ○ |
| 18 | 1.8 | 8.77 | ○ | ○ |
| 19 | 2.8 | 8.77 | ○ | ○ |
| 20 | 3.8 | 8.77 | ○ | ○ |
| 21 | 1.8 | 12.51 | △ | ○ |
| 22 | 2.8 | 12.51 | △ | ○ |
| 23 | 3.8 | 12.51 | △ | ○ |

FIG. 9

| Vc ($mm^3$) | RESIDUAL RATIO OF Ir ALLOY (%) | RESIDUAL RATIO OF Pt ALLOY (%) |
|---|---|---|
| 0.64 | 22 | 56 |
| 1.03 | 32 | 62 |
| 1.52 | 49 | 70 |
| 1.79 | 90 | 85 |
| 2.1 | 92 | 88 |
| 2.42 | 95 | 91 |
| 3.15 | 97 | 93 |
| 3.96 | 97 | 93 |
| 4.87 | 98 | 93 |
| 5.88 | 98 | 93 |
| 6.98 | 98 | 93 |
| 8.17 | 98 | 93 |

SPARK PLUG

TECHNICAL FIELD

The present invention relates to a spark plug which is incorporated in an internal combustion engine to ignite an air-fuel mixture.

BACKGROUND ART

Conventionally, a spark plug for ignition is used in an internal combustion engine. A spark plug in general includes: a center electrode; an insulator for holding the center electrode in an axial hole; a metal shell for holding the insulator by surrounding its radial periphery; and a ground electrode having one end portion joined to the metal shell and the other end portion, a spark discharge gap being formed between the other end portion and the center electrode. Further, as spark discharge is generated in the spark discharge gap, the ignition of an air-fuel mixture is ignited.

In recent years, it has become necessary to enlarge valve diameters of an intake valve and an exhaust valve which are provided in an engine for a higher engine output, and to secure a larger water jacket for the engine to improve a water cooling system. Since the mounting space for the spark plug which is mounted on the engine becomes small, the spark plug is required to smaller in diameter. However, if the spark plug becomes smaller in diameter, the insulation distance between the insulator and the metal shell becomes narrow. As a result, the spark plug fails to discharge sparks in a regular spark discharge gap, and side sparks are prone to be generated from the center electrode to the metal shell along the insulator. Further, in a dry fouling state, flashover are likely to occur. This is due to the fact that electrically conductive carbon and the like deposited on the surface of the insulator causes a deterioration in the insulation properties between the insulator and the metal shell. In this case, it is necessary to ensure insulation properties on each occasion by burning off the carbon adhered on the insulator by increasing the front end temperature of the insulator.

Accordingly, for example, a spark plug has been proposed in which the following formulae are satisfied: $(X+0.3Y+Z)/G \geqq 2$, $Y1\ (mm) \geqq 1$, $W/Z \geqq 4$, and $1.25 \leqq Z\ (mm) \leqq 1.55$ where X is the distance between the insulator and the center electrode at a front end portion of the insulator, Y is a creeping distance of the surface of the insulator outside the metal shell, Y1 is an amount of protrusion of the insulator from the metal shell, Z is a pocket gap, G is the distance of the spark discharge gap, and W is the length on the surface of the insulator up to a portion where the distance between the insulator and the metal shell becomes G or less inside the metal shell (e.g., see patent document 1). This spark plug excels in that, by respectively defining the aforementioned various distances among the component parts, even a spark plug with its diameter reduced is able to allow sparks to be discharged stably to a regular spark discharge gap when the spark plug is not dry fouling, and is able to ensure ignitability even in cases where the spark plug has dry-fouled and creeping discharge such as side sparks and flashover have occurred.

Patent Document 1: JP-A-2005-116513

DISCLOSURE OF THE INVENTION

Problem to be Solved by the Invention

However, even if it is possible to ignite in the state in which the spark plug has dry-fouled and creeping discharge has occurred, as in the case of the spark plug according to Patent Document 1, unless the carbon adhered on the insulator is burned off immediately, a large amount of carbon is likely to be adhered on the surface of the insulator. In this case, since considerable time is required until all the carbon is burned off, a situation may occur in which carbon cannot be completely removed from the insulator. Hence, there has been a problem in that recovery cannot be expected to the state in which a proper ignition phenomenon can be obtained. Accordingly, there has been a demand for a method which makes it possible to speedily recover from a dry fouling state to a proper state by, for instance, burning off the carbon adhered on the insulator.

The present invention has been devised to overcome the above-described problems, and an object thereof is to provide a spark plug capable of speedily burning off the carbon adhered on the insulator.

Means for Solving the Problem

In order to achieve the above-described object, a spark plug of the invention according to claim 1 comprises: a center electrode extending in an axial direction; an insulator which has an axial hole extending in the axial direction and holds the center electrode on a front end side of an interior of the axial hole; a metal shell for holding the insulator by surrounding its periphery in a subassembly in which the center electrode is held in the axial hole of the insulator; and a ground electrode comprising one end portion joined to the metal shell and another end portion, a spark discharge gap being formed between the another end portion and the center electrode, wherein the following formula is satisfied: $H \geqq 1.8$ mm, and the following formulae are satisfied: $4.02\ mm^3 < Vi \leqq 12.51\ mm^3$; $2.10\ mm^3 \leqq Vc \leqq 6.42\ mm^3$; and $Vc/Vi \leqq 1.03$, where: H is a length of the insulator protruding from a front end face of the metal shell toward a front end side thereof in the axial direction; Vi is a volume of a portion of the insulator which corresponds to a range of 1.5 mm from a front end of the insulator toward a rear end thereof in the axial direction; and Vc is a volume of a portion of the center electrode which corresponds to the range of 1.5 mm in the axial direction.

In a spark plug according to claim 2, in addition to the configuration of the invention recited in claim 1, the following formulae are satisfied: $4.22\ mm^3 \leqq Vi \leqq 8.77\ mm^3$, $2.10\ mm^3 \leqq Vc \leqq 5.36\ mm^3$, and $Vc/Vi \leqq 0.84$.

In a spark plug according to claim 3, in addition to the configuration of the invention recited in claim 1 or 2, the metal shell comprises a mounting threaded portion on an outer peripheral surface thereof, the mounting threaded portion comprising a thread formed thereon to be screwed into a mounting threaded hole of an internal combustion engine, and an outside diameter of the mounting threaded portion is M10 or less in a nominal diameter.

Advantages of the Invention

In the spark plug of the invention according to claim 1, since the following formula is satisfied: $H \geqq 1.8$ mm, and the following formulae are satisfied: $4.02\ mm^3 < Vi \leqq 12.51\ mm^3$, $2.10\ mm^3 \leqq Vc \leqq 6.42\ mm^3$, and $Vc/Vi \leqq 1.03$, it is possible to speedily increase the temperature of the insulator. In general, the smaller the volume Vc of the insulator, the more the effect on carbon fouling can be recognized; however, since the temperature of the insulator around the ignition portion rises, the durability of the insulator deteriorates. In the invention, by using spark plugs with Vc exhibiting excellent recovery of carbon fouling, optimum numeral ranges of H, Vi, Vc, and Vc/Vi were found out by evaluating the durability of insulators in an engine and evaluating the durability of center electrodes. In consequence, since it is possible to speedily increase the temperature of the insulator, it is possible to speedily burn off the carbon adhered on the insulator. Further, as the carbon is speedily burned off, high advantages are exhibited in the prevention of occurrence of the creeping discharge such as side sparks and in securing insulation resistance required for the automobile operation.

In addition, in the spark plug of the invention according to claim 2, by further limiting the numerical ranges limited in claim 1, it is possible to speedily increase the temperature of the insulator. Accordingly, it is possible to more speedily burn off the carbon adhered on the insulator.

In addition, in the spark plug of the invention according to claim 3, in addition to the advantages of the invention according to claim 1 or 2, if the insulator whose temperature rise performance has been increased, mentioned above, is used for a reduced-diameter spark plug in which the outside diameter of the thread of the mounting threaded portion is not more than M10 in the nominal diameter, even if the clearance between the inner periphery of the metal shell and the outer periphery of the insulator is narrow, the carbon adhered on the insulator can be burned off speedily. Hence, since it is possible to prevent the occurrence of creeping discharge occurring from the center electrode to the metal shell along the insulator, it is possible to stably ensure proper ignition of the air-fuel mixture.

BRIEF DESCRIPTION OF DRAWINGS

FIG. 4 is a table showing the results of a test section 1 of Example 1;

FIG. 5 is a table showing the results of a test section 2 of Example 1;

FIG. 6 is a table showing the results of a test section 3 of Example 1;

FIG. 7 is a table showing the results of a test section 4 of Example 1;

FIG. 8 is a table showing the results of Example 2;

FIG. 9 is a table showing the results of Example 3; and

DESCRIPTION OF REFERENCE SYMBOLS

Figure 1:
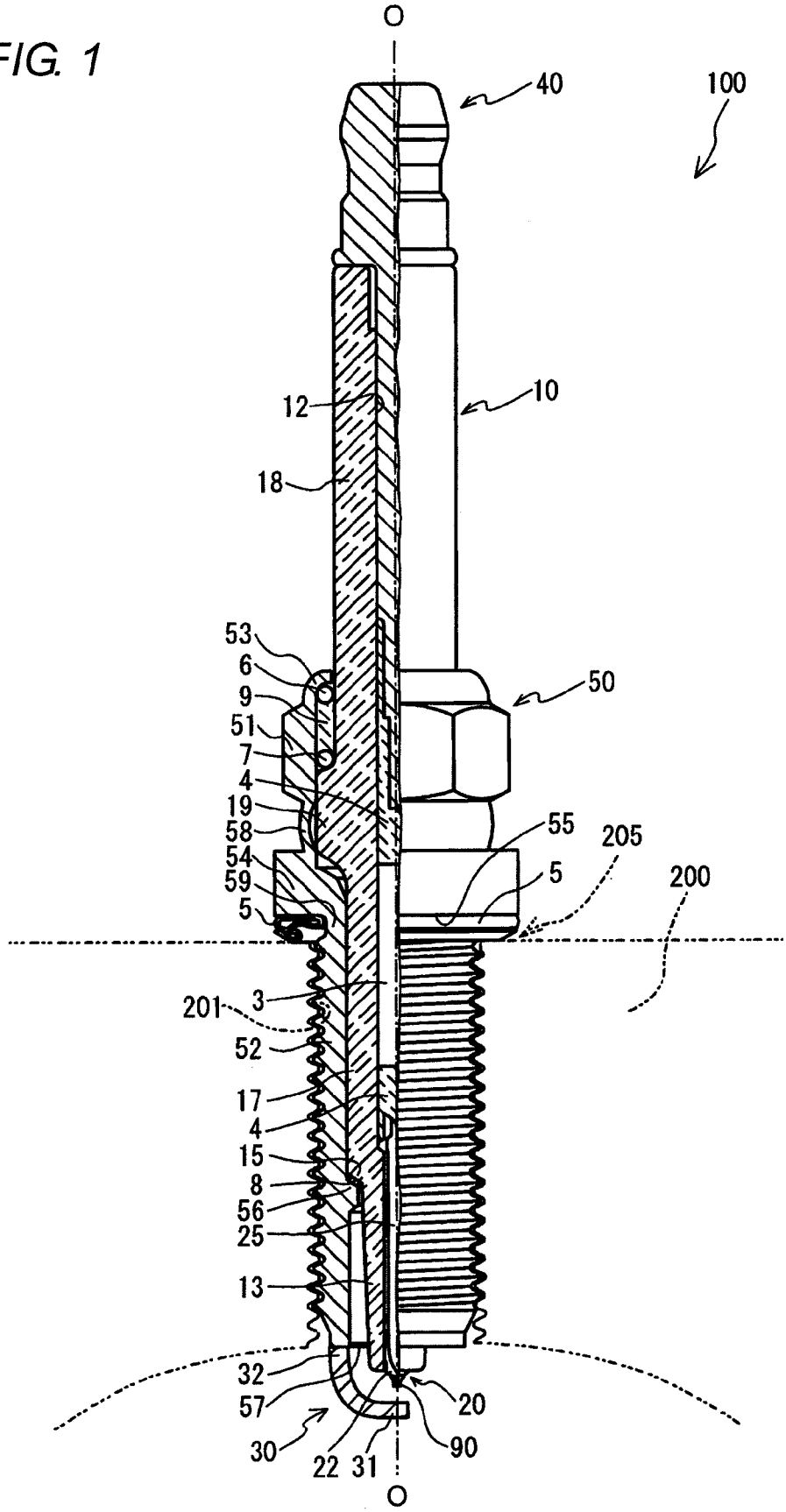
FIG. 1 is a partial cross-sectional view of a spark plug 100.

10: insulator
11: front end portion
12: axial hole
20: center electrode
22: front end portion
30: ground electrode
50: metal shell
57: front end face
60: subassembly
90: electrode tip
100: spark plug
H: amount of protrusion of the insulator
Vi: front-end side volume of the insulator
Vc: front-end side volume of the center electrode

BEST MODE FOR CARRYING OUT THE INVENTION

Figure 2:
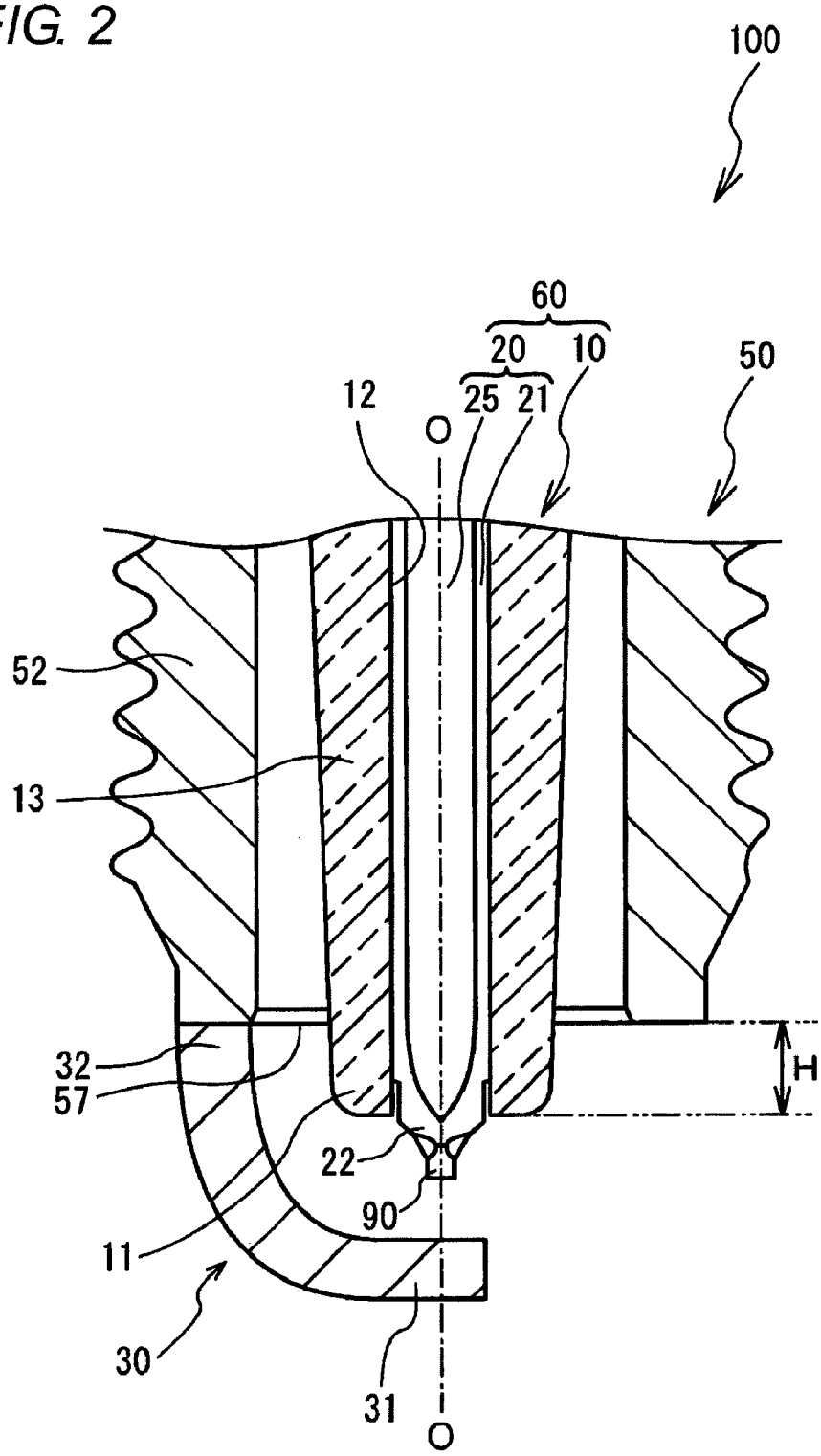
FIG. 2 is an enlarged view of a front end portion 22 and its vicinity of a center electrode 20 of the spark plug 100

Hereafter, referring to the drawings, a description will be given of an embodiment of a spark plug embodying the invention. First, referring to FIGS. 1 and 2, a description will be given of the structure of a spark plug as an example. FIG. 1 is a partial cross-sectional view of the spark plug 100, and FIG. 2 is an enlarged view of a front end portion 22 and its vicinities of a center electrode 20 of the spark plug 100. It should be noted that, in FIG. 1, a description will be given by assuming that the direction of an axis O of the spark plug 100 is a vertical direction in the drawing, and that the lower side is a front end side of the spark plug 100, and the upper side is a rear end side thereof.

As shown in FIG. 1, the spark plug 100 includes an insulator 10; a metal shell 50 for holding this insulator 10; the center electrode 20 held in the insulator 10 in the direction of the axis O; a ground electrode 30 which has a base portion 32 welded to a front end face 57 of the metal shell 50 and in which one side surface of its distal end portion 31 opposes the front end portion 22 of the center electrode 20; and a metallic terminal 40 provided on a rear end portion of the insulator 10.

First, a description will be given of the insulator 10. As is generally known, the insulator 10 is formed by sintering alumina or the like and has a cylindrical shape in which an axial hole 12 extending in the direction of the axis O is formed at the axial center. A collar portion 19 having a largest outside diameter is formed substantially in the center in the direction of the axis O, and a rear-end side barrel portion 18 is formed on the base end side thereof (on the upper side in FIG. 1). A front-end side barrel portion 17 having a smaller outside diameter than the rear-end side barrel portion 18 is formed on the front end side of the collar portion 19 (on the lower side in FIG. 1). Further, a long leg portion 13 having a smaller outside diameter than the front-end side barrel portion 17 is formed forwardly of that front-end side barrel portion 17. The long leg portion 13 has a gradually reduced diameter toward the front end side, and when the spark plug 100 is mounted in an engine head 200 of the internal combustion engine, the long leg portion 13 is exposed to the interior of its combustion chamber. Additionally, a portion between the long leg portion 13 and the front-end side barrel portion 17 is formed as a stepped portion 15.

Next, a description will be given of the center electrode 20. As shown in FIG. 2, the center electrode 20 is a rod-like electrode having a structure in which a core member 25 is embedded in an electrode base metal 21 formed of nickel or an alloy having nickel as a principal component, such as INCONEL (trade name) 600 or 601, the core member 25 being formed of copper or an alloy having copper as a principal component, which excels in thermal conductivity more than the electrode base metal 21. Generally, the center electrode 20 is fabricated by filling the core member 25 into the electrode base member 21 formed into a bottomed cylindrical shape and by stretching it by effecting extrusion from the bottom side. The core member 25 has a substantially fixed outside diameter at its barrel portion, but is formed in a tapered shape at its front end side.

In addition, the front end portion 22 of the center electrode 20 protrudes from a front end portion 11 of the insulator 10 and is formed to have a smaller diameter toward the front end side. An electrode tip 90 formed of noble metal is welded to a front end face of the front end portion 22 to improve spark wear resistance. The two members are joined by laser welding around the outer periphery while aiming at the mating surface between the front end portion 22 of the center electrode 20. Further, as the both materials are fused and blended by laser irradiation, the electrode tip 90 and the center electrode 20 are joined firmly.

In addition, the center electrode 20 extends toward the rear end side inside the axial hole 12 and is electrically connected to the metallic terminal 40 on the rear side (upper side in FIG. 1) through a seal body 4 and a ceramic resistor 3 (see FIG. 1). A high-tension cable (not shown) is connected to the metallic terminal 40 through a plug cap (not shown), and a high voltage is adapted to be applied thereto. Here, a subassembly in which the center electrode 20 is held in the axial hole 12 of the insulator 10 will be referred to as a subassembly 60 (see FIGS. 2 and 3).

Next, a description will be given of the ground electrode 30. The ground electrode 30 is formed of a metal which has high corrosion resistance, and a nickel alloy such as Inconel (trade name) 600 or 601 is used, by way of example. As for this ground electrode 30, a cross section in its longitudinal direction has a substantially rectangular shape, and its base portion 32 is jointed to the front end face 57 of the metal shell 50. Further, the distal end portion 31 of the ground electrode 30 is bent such that one side end side thereof opposes the front end portion 22 of the center electrode 20.

Next, a description will be given of the metal shell 50. The metal shell 50 shown in FIG. 1 is a cylindrical fitting for fixing the spark plug 100 to the engine head 200 of the internal combustion engine. The metal shell 50 holds within its interior the insulator 10 in such a manner as to surround its portion extending from a portion of the rear—end side barrel portion 18 to the long leg portion 13. The metal shell 50 is formed of low carbon steel and has a tool engagement portion 51 with which an unillustrated spark plug wrench is engaged and a mounting threaded portion 52 having a thread formed thereon to be screwed into a mounting threaded hole 201 of the engine head 200 of the internal combustion engine.

Further, a collar-like seal portion 54 is formed between the tool engagement portion 51 and the mounting threaded portion 52 of the metal shell 50. An annular gasket 5 formed by bending a plate body is fitted on a thread neck 59 between the mounting threaded portion 52 and the seal portion 54. The gasket 5 is deformed by being pressed and crushed between a seating face 55 of the seal portion 54 and an opening peripheral edge portion 205 of the mounting threaded hole 201, and seals the gap therebetween, to thereby prevent a gastightness failure within the engine through the mounting threaded hole 201.

In addition, a thin-walled crimping portion 53 is provided rearwardly of the tool engagement portion 51 of the metal shell 50, and a buckled portion 58 which is thin-walled in the same way as the crimping portion 53 is provided between the seal portion 54 and the tool engagement portion 51. Further, annular ring members 6 and 7 are interposed between an inner peripheral surface of the metal shell 50 and an outer peripheral surface of the rear-end side barrel portion 18 of the insulator 10 from the tool engagement portion 51 to the crimping portion 53, and a powder of talc 9 is filled between the both ring members 6 and 7. As the crimping portion 53 is crimped in such a way as to be bent inwardly, the insulator 10 is pressed toward the front end side inside the metal shell 50 through the ring members 6 and 7 and the talc 9.

As a result, the stepped portion 15 of the insulator 10 is supported through an annular plate packing 8 by a stepped portion 56 formed at the position of the mounting threaded portion 52 on the inner periphery of the metal shell 50, thereby integrating the metal shell 50 and the insulator 10. At this time, the gas-tightness between the metal shell 50 and the insulator 10 is maintained by the plate packing 8, thereby preventing the efflux of the combustion gases. In addition, at the time of crimping, the buckled portion 58 is adapted to be deformed outwardly in consequence of the application of the compressive force, and enhances the gas-tightness of the interior of the metal shell 50 by increasing the compression length of the talc 9 in the direction of the axis O.

With the spark plug 100 having the above-described structure, when carbon is adhered on the surface on the front end side of the insulator 10 and assumes a dry fouling state, the insulation resistance value declines, and the generated voltage of the ignition coil declines. If the generated voltage becomes lower than the required voltage (voltage for a spark discharge in the spark gap) of the spark plug, the spark discharge fails, causing misfiring. To prevent such misfiring, the front end temperature of the insulator 10 is increased to about 450° C. This makes it possible to burn off the carbon adhered on the insulator 10, so that it is possible to prevent misfiring. Such a phenomenon is referred to as "self-cleaning."

By effecting such self-cleaning speedily, it is possible to achieve recovery from the dry fouling state to the state in which proper ignition performance can be obtained. Further, to effect the self-cleaning speedily, it is necessary to speedily increase the front end temperature of the insulator 10. Accordingly, in this embodiment, in order to improve the temperature rise performance of the front end side of the insulator 10, the amount of protrusion (below-described H) of the front end side of the insulator 10, the volume (below-described Vi) of the front end side of the insulator 10, and the volume (below-described Vc) of the front end side of the center electrode are respectively defined.

Figure 3:
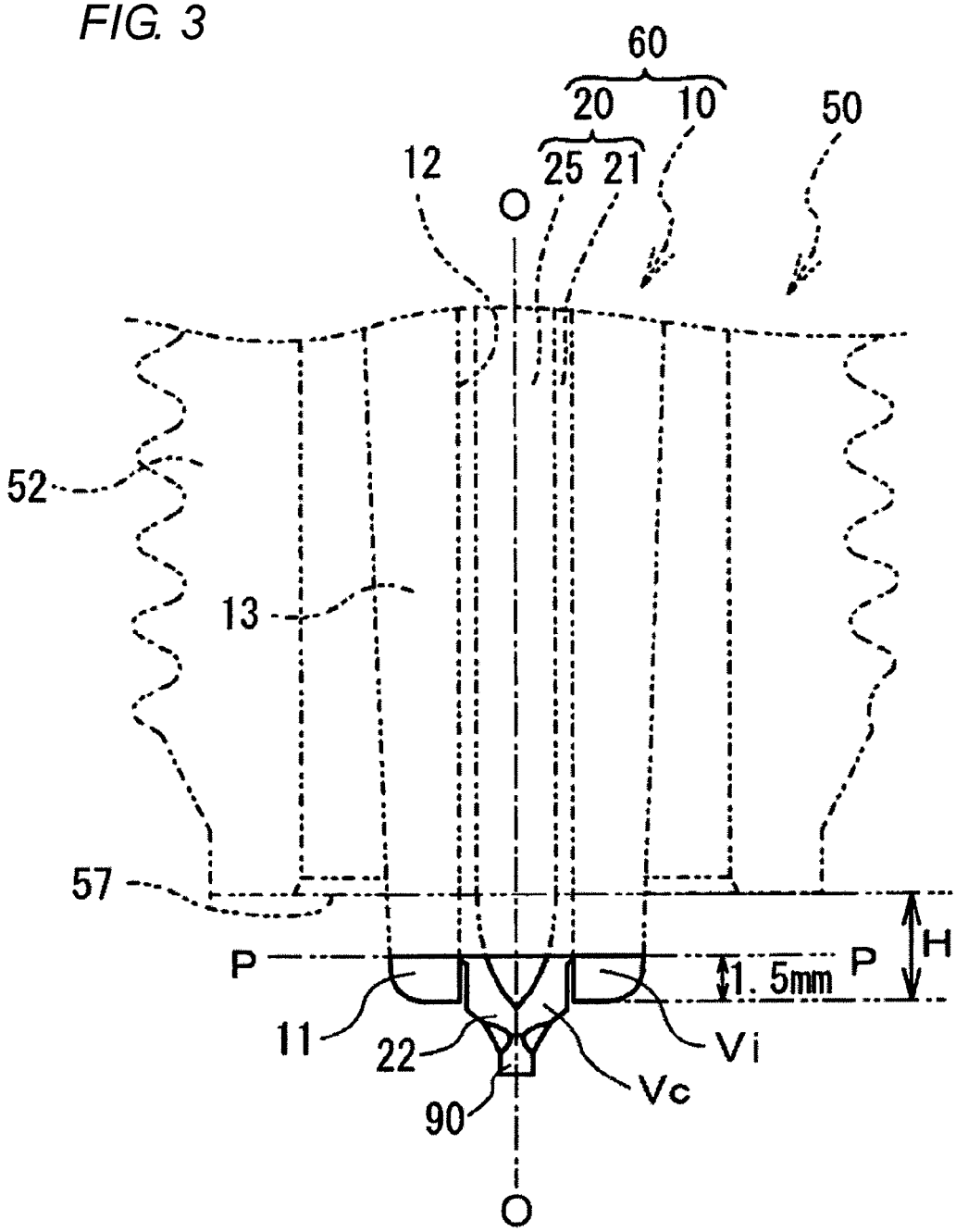
FIG. 3 is a diagram illustrating the position of a front-end side volume Vi of an insulator 10 and the position of a front-end side volume Vc of a center electrode 20.

Next, referring to FIGS. 2 and 3, a description will be given of parameters which are defined for the spark plug 100. FIG. 3 is a diagram illustrating the position of the front-end side volume Vi of the insulator 10 and the position of the front-end side volume Vc of the center electrode 20. As shown in FIGS. 2 and 3, first, the amount of protrusion (length) of the insulator 10 protruding from the front end face 57 of the metal shell toward the front end side thereof in the direction of the axis O is set to H (mm). A plane P (its cross section is shown by the two-dotted chain line P-P), which passes a position 1.5 mm distant from the front end of the insulator 10 toward the rear end side in the direction of the axis O and is perpendicular to the axis O, is assumed. The subassembly is sectioned along this plane P. The volume of the front end side of the insulator 10 sectioned along the plane P at that time is assumed to be Vi ($mm^3$). Further, the volume of the front end side of the center electrode 20 sectioned along that plane P is assumed to be Vc ($mm^3$).

In addition, these parameters are defined by the following numerical ranges. It should be noted that the numerical ranges defined below have been derived from the results of various tests which will be described later.

$$H \geqq 1.8 \text{ mm}$$

$$4.02 \text{ mm}^3 < Vi \leqq 12.51 \text{ mm}^3$$

$$2.10 \text{ mm}^3 \leqq Vc \leqq 6.42 \text{ mm}^3$$

$$Vc/Vi \leqq 1.03$$

More preferably, the parameters are defined by the following numerical ranges:

$$H \geqq 1.8 \text{ mm}$$

$$4.22 \text{ mm}^3 \leqq Vi \leqq 8.77 \text{ mm}^3$$

$$2.10 \text{ mm}^3 \leqq Vc \leqq 5.36 \text{ mm}^3$$

$$Vc/Vi \leqq 0.84$$

As the parameters are defined by the above-described respective numerical ranges, it is possible to improve the temperature rise performance of the front end side of the insulator 10. For example, the smaller the amount of protrusion H of the insulator, the smaller the portion which is exposed to the combustion chamber, so that the front end temperature of the insulator 10 does not rise sufficiently. In this case, the carbon which is adhered on the insulator 10 cannot be burned off speedily. Hence, the rate of occurrence of abnormal combustion due to the failure of normal discharge becomes high. Accordingly, in this embodiment, H is defined as 1.8 mm or more. In consequence, since the front end side of the insulator 10 is sufficiently exposed to the combustion chamber, the front end temperature of the insulator 10 is made to rise easily. Therefore, the temperature rise performance of the insulator 10 can be improved.

In addition, the smaller the front-end side volume Vi of the insulator 10, the more the front end temperature is made to rise easily, so that the carbon adhered on the insulator 10 can be burned off speedily. However, if Vi is made excessively small, the temperature of the insulator rises around the ignition portion, so that there is a possibility of the insulator undergoing penetration fracture. On the other hand, if the front-end side volume Vi is made large, the front end temperature becomes difficult to rise. Accordingly, in this embodiment, a definition is given such that 4.02 $mm^3 < Vi \leqq 12.51\ mm^3$ (preferably 8.77 $mm^3$). In consequence, it is possible to maintain the temperature rise performance of the insulator 10 and prevent the trouble of penetration fracture of the insulator 10.

In addition, if the front-end side volume Vc of the center electrode 20 is made excessively small, the durability of the electrode tip 90 welded to the front end portion 22 of the center electrode 20 deteriorates sharply. Accordingly, in this embodiment, a definition is given such that 2.10 $mm^3 \leqq Vc \leqq 6.42\ mm^3$ (preferably 5.36 $mm^3$). In consequence, it is possible to maintain the temperature rise performance of the insulator 10 and retain the durability of the electrode tip 90. Namely, the wear of the electrode tip 90 can be prevented.

If the insulator and the center electrode whose temperature rise performance has been increased, as mentioned above, are used for a reduced-diameter spark plug in which the outside diameter of the thread of the mounting threaded portion is not more than M10 in the nominal diameter, even if the clearance between the inner periphery of the metal shell 50 and the outer periphery of the insulator 10 is narrow, the carbon adhered on the insulator 10 can be burned off speedily. Hence, since it is possible to prevent the occurrence of side sparks generated from the center electrode 20 to the metal shell 50 along the insulator, it is possible to stably ensure proper ignition of the air-fuel mixture.

Next, a description will be given of three evaluation tests for substantiating the numerical ranges of the respective parameters defined in the invention. In Example 1, a description will be given of a recovery property test on carbon fouling. In Example, 2, a description will be given of a withstand voltage test of insulators. It should be noted that, in the following description, a description will be given by abbreviating the amount of protrusion of the insulator as "H," the front-end side volume of the insulator as "Vi," and the front-end side volume of the center electrode as "Vc."

Example 1

In Example 1, the effect of H, Vi, and Vc exerted on the recovery property of carbon fouling was examined. First, in this test, four test sections in which H of the insulator differed were provided. Settings were provided such that H=0.8 mm for test section 1, H=1.8 mm for test section 2, H=2.8 mm for test section 3, and H=3.8 mm for test section 4. Pluralities of spark plugs, which satisfied H set for each test section and in which Vi and Vc were respectively varied appropriately, were respectively prepared for the respective test sections.

Next, a description will be given of the test conditions. First, spark plugs were dry-fouled on the basis of the dry fouling test of JIS D 1606 to prepare spark plugs with an insulation resistance value of 100Ω. Then, each spark plug with its insulation resistance value adjusted was mounted in an engine on a bench, and was held for two minutes under the conditions of the engine speed of 3000 rpm and the intake pressure of −30 MPa. Subsequently, the engine was set in an idling state, and the rate of occurrence of side sparks was measured for 30 seconds. It should be noted that the engine used in this test was 2 L 4-cylinder engine. Under these test conditions, an evaluation was made of the samples of the afore-mentioned spark plugs for each test section. It should be noted that the evaluation was made in three stages on the basis of the rate of occurrence of side sparks, namely, the sample of no occurrence was evaluated as "○," the sample of less than 5% as "Δ," and the sample of 5% or more as "x."

A description will be given of the results of the test section 1 with reference to FIG. 4. FIG. 4 is a table showing the results of the test section 1 of Example 1. In the test section 1, an evaluation was made of 19 samples (sample Nos. 1-1 to 1-19) in which H=0.8 mm, Vi was appropriately varied in the range of 3.91 to 13.63 ($mm^3$), and Vc was appropriately varied in the range of 2.10 to 6.98 ($mm^3$). As shown in the table, the evaluation of all the 19 samples was "x."

A description will be given of the results of the test section 2 with reference to FIG. 5. FIG. 5 is a table showing the results of the test section 2 of Example 1. In the test section 2, an evaluation was made of 22 samples (sample Nos. 2-1 to 2-22) in which H=1.8 mm, Vi was appropriately varied in the range of 1.74 to 16.51 ($mm^3$), and Vc was appropriately varied in the range of 2.10 to 8.17 ($mm^3$). It should be noted that, in the table showing the results of the test section 2, to facilitate the comparative discussion of samples for which evaluation differed, the samples are arranged from the top in the order of samples for which the evaluation was "x," samples for which the evaluation was "Δ," and samples for which the evaluation was "○."

As shown in the table, of the 22 samples, there were 8 samples for which the evaluation was "Δ" and 6 samples for which the evaluation was "○." As for the ranges of the respective parameters of the samples corresponding to "○" or "Δ," Vi was in the range of 4.02 to 12.51 ($mm^3$), Vc was in the range of 2.10 to 6.42 ($mm^3$), and Vc/Vi was in the range of 0.28 to 1.03 ($mm^3$). As for the ranges of the respective parameters of the samples corresponding to only "○," Vi was in the range of 4.02 to 8.77 ($mm^3$), Vc was in the range of 2.10 to 5.36 ($mm^3$), and Vc/Vi was in the range of 0.40 to 0.84 ($mm^3$).

A description will be given of the results of the test section 3 with reference to FIG. 6. FIG. 6 is a table showing the results of the test section 3 of Example 1. In the test section 3, an evaluation was made of 13 samples (sample Nos. 3-1 to 3-13) in which H=2.8 mm, Vi was appropriately varied in the range of 4.02 to 13.63 ($mm^3$), and Vc was appropriately varied in the range of 2.10 to 6.98 ($mm^3$). It should be noted that, in the table showing the results of the test section 3 as well, to facilitate the comparative discussion of samples for which evaluation differed, the samples are arranged from the top in the order of samples for which the evaluation was "x," samples for which the evaluation was "Δ," and samples for which the evaluation was "○."

As shown in the table, of the 13 samples, there were 6 samples for which the evaluation was "Δ" and 4 samples for which the evaluation was "○." As for the ranges of the respective parameters of the samples corresponding to "○" or "Δ," Vi was in the range of 4.02 to 12.51 ($mm^3$), Vc was in the range of 2.10 to 6.42 ($mm^3$), and Vc/Vi was in the range of 0.28 to 1.03 ($mm^3$). As for the ranges of the respective parameters of the samples corresponding to only "○," Vi was in the range of 4.02 to 8.77 ($mm^3$), Vc was in the range of 2.10 to 5.36 ($mm^3$), and Vc/Vi was in the range of 0.40 to 0.84 ($mm^3$).

A description will be given of the results of the test section 4 with reference to FIG. 7. FIG. 7 is a table showing the results of the test section 4 of Example 1. In the test section 4, an evaluation was made of 13 samples (sample Nos. 4-1 to 4-13) in which H=3.8 mm, Vi was appropriately varied in the range of 4.02 to 13.63 ($mm^3$), and Vc was appropriately varied in the range of 2.10 to 6.98 ($mm^3$). It should be noted that, in the table showing the results of the test section 4 as well, to facilitate the comparative discussion of samples for which evaluation differed, the samples are arranged from the top in the order of samples for which the evaluation was "x," samples for which the evaluation was "Δ," and samples for which the evaluation was "○."

As shown in the table, of the 13 samples, there were 6 samples for which the evaluation was "Δ" and 4 samples for which the evaluation was "○." As for the ranges of the respective parameters of the samples corresponding to "○" or "Δ," Vi was in the range of 4.02 to 12.51 ($mm^3$), Vc was in the range of 2.10 to 6.42 ($mm^3$), and Vc/Vi was in the range of 0.28 to 1.03 ($mm^3$). As for the ranges of the respective parameters of the samples corresponding to only "o," Vi was in the range of 4.02 to 8.77 ($mm^3$), Vc was in the range of 2.10 to 5.36 ($mm^3$), and Vc/Vi was in the range of 0.40 to 0.84 ($mm^3$).

Next, the results of Example 1 will be summed up. In the respective results of the test sections 1 to 4 of Example 1, if the ranges of "○" and "Δ" are taken into consideration, H, Vi, Vc, and Vc/Vi are defined by the following numerical ranges:

$$H \geqq 1.8 \text{ mm}$$

$$4.02 \text{ mm}^3 \leqq Vi \leqq 12.51 \text{ mm}^3$$

$$2.10 \text{ mm}^3 \leqq Vc \leqq 6.42 \text{ mm}^3$$

$$Vc/Vi \leqq 1.03$$

It should be noted that if only the ranges of "○" are taken into consideration, the parameters are defined by the following numerical ranges:

$$H \geqq 1.8 \text{ mm}$$

$$4.22 \text{ mm}^3 \leqq Vi \leqq 8.77 \text{ mm}^3$$

$$2.10 \text{ mm}^3 \leqq Vc \leqq 5.36 \text{ mm}^3$$

$$Vc/Vi \leqq 0.84$$

Example 2

In Example 2, a withstand voltage test of insulators was conducted in the numerical ranges defined in Example 1. First, spark plugs which satisfied the respective ranges of H and Vi, which were excellent in the recovery property at the time of fouling in Example 1, were fabricated as samples. Specifically, 23 samples were fabricated by setting, as for H, three kinds, 1.8, 2.8, and 3.8, and by appropriately varying Vi in the range of 2.47 to 12.51 ($mm^3$). It should be noted that the spark discharge gap was adjusted to 1.3 mm by taking electrode wear into consideration.

Next, a description will be given of the test conditions. As the engine, a 660 cc 3-cylinder turbocharged engine was used. As for the test pattern, the pattern consisted of 1 minute of idling (800 rpm) and 3 minutes at wide open throttle, and this pattern was repeated for 10 hours. Then, with respect to the respective samples after 10 hours, the recovery property of fouling was evaluated, and the voltage resistance of the insulator was evaluated. It should be noted that the recovery property of fouling was evaluated in terms of "○," "Δ," and "x." As for the voltage resistance of the insulator, a case in which penetration fracture occurred in the insulator was evaluated as "x," and a case in which penetration did not occur was evaluated as "○."

Next, a description will be given of the results of the withstand voltage test with reference to FIG. 8. FIG. 8 is a table showing the results of Example 2. As for the fouling recovery property, irrespective of H, three samples (sample Nos. 21, 22, and 23) in which Vi was 12.51 were respectively "Δ," whereas the other samples were all "○," and "x" samples were none. Meanwhile, as for the presence or absence of the penetration fracture of the insulator, irrespective of H, the samples in which Vi was in the range of 2.47 to 4.02 ($mm^3$) were all "x," whereas the samples in which Vi was in the range of 4.22 to 12.51 ($mm^3$) were all "○."

Next, the results of Example 2 will be summed up. In the case where the results of Example 2 are reflected on the numerical ranges defined in Example 1, since penetration fracture occurred in the insulator in the samples with Vi=4.02 ($mm^3$), Vi must exceed at least 4.02. Accordingly, the numerical range of Vi defined in Example 1 is further defined as follows:

$$4.02 \text{ mm}^3 < Vi \leqq 12.51 \text{ (preferably 8.77) mm}^3$$

Example 3

In Example 3, the effect of Vc exerted on the durability of the electrode tip welded to the front end portion of the center electrode was examined. In the durability test of the electrode tips, the residual ratio of the electrode tip after 100 hours of the durability test with the spark plug mounted in the engine was calculated. Here, the term "residual ratio" refers to the residual ratio of a portion of the electrode tip which does not include a molten portion, and was calculated by the following formula:

Residual ratio=(volume of electrode tip after durability test)/(volume of electrode tip before durability test)

It should be noted that the term "volume of electrode tip" refers to the volume of a portion of the electrode tip which does not include a molten portion.

Next, a description will be given of the test conditions. As the engine, a 2 L 4-cylinder engine was used. Then, a durability test was conducted continuously at WOT (5000 rpm) for 100 hours, and the residual ratio of the electrode tip after the durability test was calculated. As for the electrode tips, two types, i.e., one made of an iridium (Ir) alloy and another made of a platinum (Pt) alloy, were studied. Then, by appropriately varying the Vc of the center electrode, to which each of these electrode tips is welded, in the range of 0.64 to 8.17, 12 spark plugs each provided with an iridium alloy-made electrode tip and 12 spark plugs each provided with a platinum alloy-made electrode tip were prepared as samples.

Figure 10:
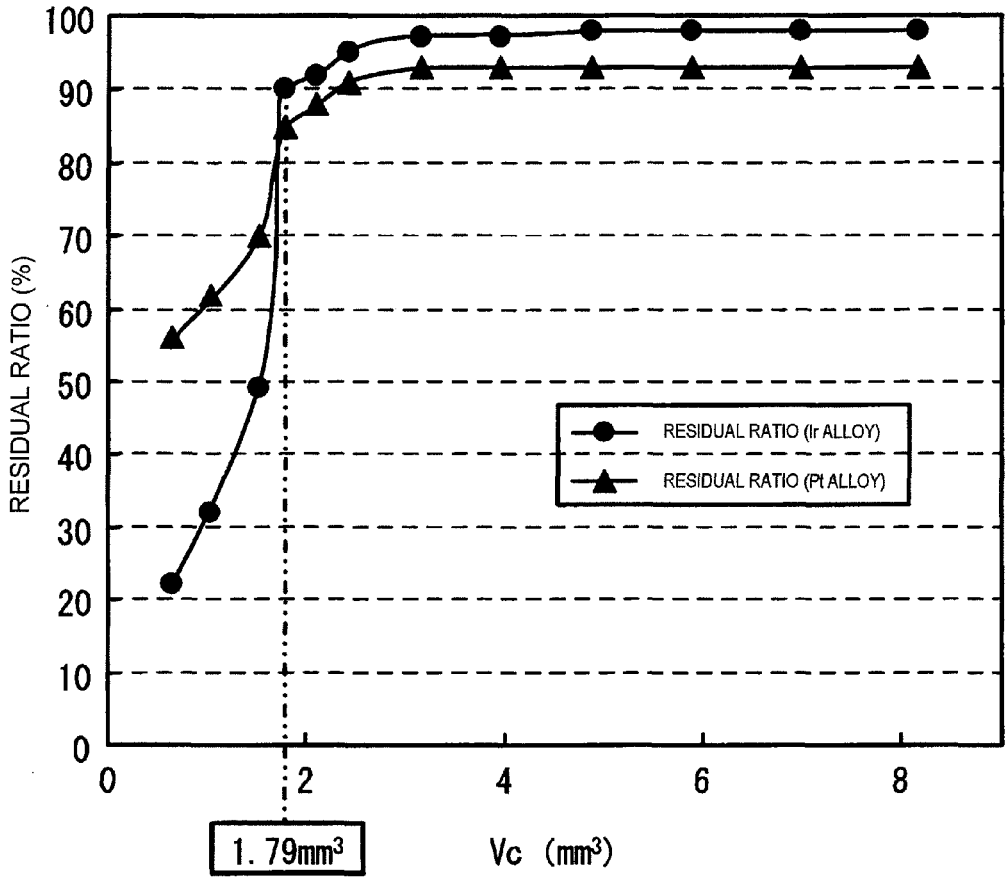
FIG. 10 is a graph showing the results of Example 3.

Next, a description will be given of the results of the durability test with reference to FIGS. 9 and 10. FIG. 9 is a table showing the results of Example 3, and FIG. 10 is a graph showing the results of Example 3. First, a discussion will be given starting with the iridium alloy-made electrode tips. In the range where Vc was 0.64 $mm^3$ to 1.52 $mm^3$, the residual ratio gradually increased from 22% to 49%. Then, when Vc exceeded 1.52 $mm^3$, the residual ratio increased sharply, and when Vc was 1.79 $mm^3$, the residual ratio rose to 90% at a stroke. Subsequently, the residual ratio shifted to 98%. Meanwhile, a similar result was obtained for the platinum alloy-made electrode tips as well. Namely, in the range where Vc was 0.64 $mm^3$ to 1.52 $mm^3$, the residual ratio gradually increased from 56% to 70%. Then, when Vc exceeded 1.52 $mm^3$, the residual ratio increased sharply, and when Vc was 1.79 $mm^3$, the residual ratio rose to 85% at a stroke. Subsequently, the residual ratio shifted to 93%.

Next, the results of Example 3 will be summed up. In both electrode tips made of an iridium alloy and made of a platinum alloy, the residual ratio of the electrode tip became sharply high when Vc was 1.79 $mm^3$ or higher. Accordingly, if Vc is 1.79 $mm^3$ or higher, the durability of the electrode tip can be retained, and therefore it was substantiated that the lower limit (Vc=2.10 $mm^3$) of the numerical range of Vc defined in Example 1 satisfies this condition.

Based on the results of the foregoing Examples 1 to 3, it was substantiated that H, Vi, Vc, and Vc/Vi can be defined by the following numerical ranges:

$$H \geqq 1.8 \text{ mm}$$

$$4.02 \text{ mm}^3 < Vi \leqq 12.51 \text{ (preferably 8.77) mm}^3$$

$$2.10 \text{ mm}^3 \leqq Vc \leqq 6.42 \text{ (preferably 5.36) mm}^3$$

$$Vc/Vi \leqq 1.03 \text{ (preferably 0.84)}$$

It should be noted that the lower limit of Vc/Vi is a value which is automatically determined by the lower limit of Vc and the lower limit of Vi.

As described above, with the spark plug 100 in accordance with this embodiment, in order to improve the temperature rise performance of the front end side of the insulator 10, the amount of protrusion H (mm) of the insulator 10, the front-end side volume Vi ($mm^3$) of the insulator 10, and the front-end side volume Vc ($mm^3$) of the center electrode 20 are respectively defined. In consequence, it is possible to improve the recovery property of carbon fouling while retaining the voltage resistance of the insulator 10 and the durability of the center electrode 20. In addition, since the recovery property of carbon fouling improves, it is possible to prevent the occurrence of side sparks generated from the center electrode 20 to the metal shell 50 along the insulator 10, thereby making it possible to stably ensure proper ignition of the air-fuel mixture.

It should be noted that, needless to say, various modifications are possible in the invention. For example, although it has been described that the materials of the electrode base metal 21 and the core member 25 constituting the center electrode 20 are respectively formed of nickel or an alloy having nickel as a principal component and copper or an alloy having copper as a principal component, it is possible to use other metals if a combination of a metal (such as an Fe alloy) excelling in the spark wear resistance and a metal (such as an Ag alloy) more excelling in the thermal conductivity than the electrode base member 21 is to be adopted.

Although the present invention has been described in detail and with reference to a specific embodiment, it is apparent to those skilled in the art that various changes and modifications may be made without departing from the spirit and scope of the invention.

This application is based on Japanese Patent Application filed on Mar. 21, 2008 (Japanese Patent Application No. 2008-72731), the contents of which are incorporated herein by reference.

The invention claimed is:

1. A spark plug comprising:

a center electrode extending in an axial direction;

an insulator which has an axial hole extending in the axial direction and holds the center electrode on a front end side of an interior of the axial hole;

a metal shell for holding the insulator by surrounding its periphery in a subassembly in which the center electrode is held in the axial hole of the insulator; and a ground electrode comprising one end portion joined to the metal shell and another end portion, a spark discharge gap being formed between the another end portion and the center electrode, wherein the following formula is satisfied:

$$H \geqq 1.8 \text{ mm},$$

and the following formulae are satisfied:

$$4.02 \text{ mm}^3 < Vi \leqq 12.51 \text{ mm}^3;$$

$$2.10 \text{ mm}^3 \leqq Vc \leqq 6.42 \text{ mm}^3; \text{ and}$$

$$Vc/Vi \leqq 1.03,$$

where:

H is a length of the insulator protruding from a front end face of the metal shell toward a front end side thereof in the axial direction;

Vi is a volume of a portion of the insulator which corresponds to a range of 1.5 mm from a front end of the insulator toward a rear end thereof in the axial direction; and Vc is a volume of a portion of the center electrode which corresponds to the range of 1.5 mm in the axial direction.

2. The spark plug according to claim 1, wherein the following formulae are satisfied:

$$4.22 \text{ mm}^3 \leqq Vi \leqq 8.77 \text{ mm}^3,$$

$$2.10 \text{ mm}^3 \leqq Vc \leqq 5.36 \text{ mm}^3, \text{ and}$$

$$Vc/Vi \leqq 0.84.$$

3. The spark plug according to claim 2, wherein the metal shell comprises a mounting threaded portion on an outer peripheral surface thereof, the mounting threaded portion comprising a thread formed thereon to be screwed into a mounting threaded hole of an internal combustion engine, and wherein an outside diameter of the mounting threaded portion is M10 or less in a nominal diameter.

4. The spark plug according to claim 1, wherein the metal shell comprises a mounting threaded portion on an outer peripheral surface thereof, the mounting threaded portion comprising a thread formed thereon to be screwed into a mounting threaded hole of an internal combustion engine, and wherein an outside diameter of the mounting threaded portion is M10 or less in a nominal diameter.

* * * * *